US011944200B2

(12) United States Patent
Reeves

(10) Patent No.: US 11,944,200 B2
(45) Date of Patent: Apr. 2, 2024

(54) SELF CLEANING CHAIR ASSEMBLY

(71) Applicant: Kerry Reeves, McAllen, TX (US)

(72) Inventor: Kerry Reeves, McAllen, TX (US)

( * ) Notice: Subject to any disclaimer, the term of this patent is extended or adjusted under 35 U.S.C. 154(b) by 189 days.

(21) Appl. No.: 17/709,881

(22) Filed: Mar. 31, 2022

(65) Prior Publication Data

US 2023/0309697 A1 Oct. 5, 2023

(51) Int. Cl.

| | |
|---|---|
| ***A47C 1/11*** | (2006.01) |
| ***A47C 1/04*** | (2006.01) |
| ***A47C 1/06*** | (2006.01) |
| ***A47L 7/00*** | (2006.01) |
| ***A47L 9/14*** | (2006.01) |
| ***A47L 9/24*** | (2006.01) |
| ***A47L 9/28*** | (2006.01) |

(52) U.S. Cl.

CPC ..... *A47C 1/11* (2013.01); *A47C 1/04* (2013.01); *A47C 1/06* (2013.01); *A47L 7/0047* (2013.01); *A47L 7/0066* (2013.01); *A47L 9/14* (2013.01); *A47L 9/24* (2013.01); *A47L 9/2857* (2013.01); *A47L 9/2868* (2013.01)

(58) Field of Classification Search

None

See application file for complete search history.

(56) References Cited

U.S. PATENT DOCUMENTS

| | | | | |
|---|---|---|---|---|
| 2,590,673 A | | 3/1952 | Bezanson | |
| 3,994,528 A | | 11/1976 | Humphrey | |
| 4,136,907 A | | 1/1979 | Hermanns | |
| 4,240,662 A | * | 12/1980 | Anderson | A47C 1/10 297/182 |
| 6,675,436 B1 | | 1/2004 | Fratoni, Jr. | |
| 6,851,748 B1 | | 2/2005 | Garrick | |
| 2012/0222250 A1 | * | 9/2012 | Conrad | A47L 9/2857 15/347 |
| 2012/0222251 A1 | * | 9/2012 | Conrad | A47L 9/0036 15/347 |
| 2015/0257960 A1 | * | 9/2015 | Reyes | A47C 20/023 5/611 |
| 2021/0145178 A1 | * | 5/2021 | Riley | A47C 1/03222 |
| 2022/0151448 A1 | * | 5/2022 | Friedrich | A47L 7/0019 |

FOREIGN PATENT DOCUMENTS

| | | | | |
|---|---|---|---|---|
| CN | 108030298 A | * | 5/2018 | |
| WO | WO2016205278 | | 2/2005 | |
| WO | WO-2015078331 A1 | * | 6/2015 | A47L 9/0036 |

* cited by examiner

*Primary Examiner* — David E Allred

(57) ABSTRACT

A self cleaning chair assembly for suctioning up hair as it is cut from a client includes a base, in which a vacuum module is positioned, and a chair. The chair is rotatably engaged to and is selectively extensible from the base. A tube is engaged to the chair and extends along a rear edge of a seat of the chair. A plurality of openings is positioned in the tube. An intake pipe is engaged to and extends from the vacuum module. The intake pipe extends substantially circumferentially around a lower end of the base. A plurality of apertures extends through the base and into the intake pipe. A hose is engaged to and extends between the intake pipe and the tube. The vacuum module suctions hair trimmed from the client from a surface proximate to the base, through the apertures, and from the chair, through the openings.

14 Claims, 7 Drawing Sheets

SELF CLEANING CHAIR ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to chair assembly and more particularly pertains to a new chair assembly for suctioning up hair as it is cut from a client. The present invention discloses a chair assembly having a vacuum module in its base for cleaning hair from a surface proximate to the base and from a seat of the chair assembly.

(2) Description of Related Art Including Information Disclosed Under 37 CFR 1.97 and 1.98

The prior art relates to chair assemblies having vacuum modules for cleaning up hair. Prior art chair assemblies may comprise vacuum modules positioned in or attachable to bases of the chair assemblies, wherein the vacuum modules clean hair from surfaces proximate to the bases of the chair assemblies. What is lacking in the prior art is a chair assembly having a vacuum module in its base which cleans hair from a surface proximate to the base of the chair assembly and from a seat of the chair assembly.

(h) BRIEF SUMMARY OF THE INVENTION

An embodiment of the disclosure meets the needs presented above by generally comprising a base, which defines an interior space, and a chair. The base is configured to be positioned on a substantially horizontal surface. The chair is rotatably engaged to an upper end of the base. The chair is selectively extensible from the base. The chair comprises a backrest, which is engaged to and which extends from a rear edge of a seat. The seat and the backrest are configured to seat a client and to support a back of the client, respectively.

A tube is engaged to the chair and extends along the rear edge of the seat. A plurality of openings is positioned in the tube.

A vacuum module is engaged to the base and is positioned in the interior space. An intake pipe is engaged to and extends from an inlet of the vacuum module. The intake pipe extends substantially circumferentially around a lower end of the base. A plurality of apertures extends through the base and into the intake pipe. A hose is engaged to and extends between the intake pipe so that the tube is in fluidic communication with the vacuum module. The vacuum module is configured to suction up hair trimmed from the client from the substantially horizontal surface proximate to the base and from the chair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
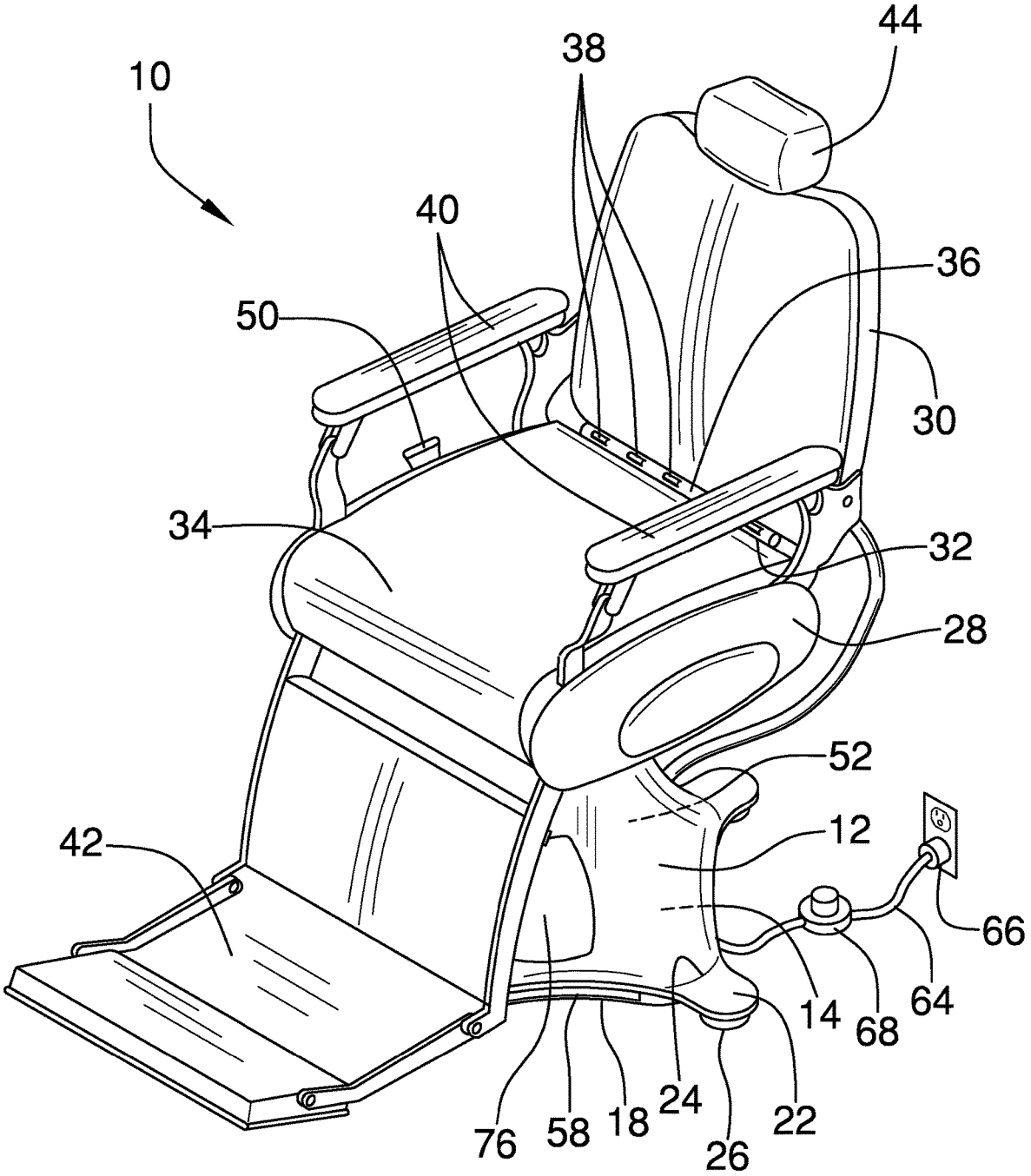
FIG. 1 is an isometric view of a self cleaning chair assembly according to an embodiment of the disclosure.
Figure 2:
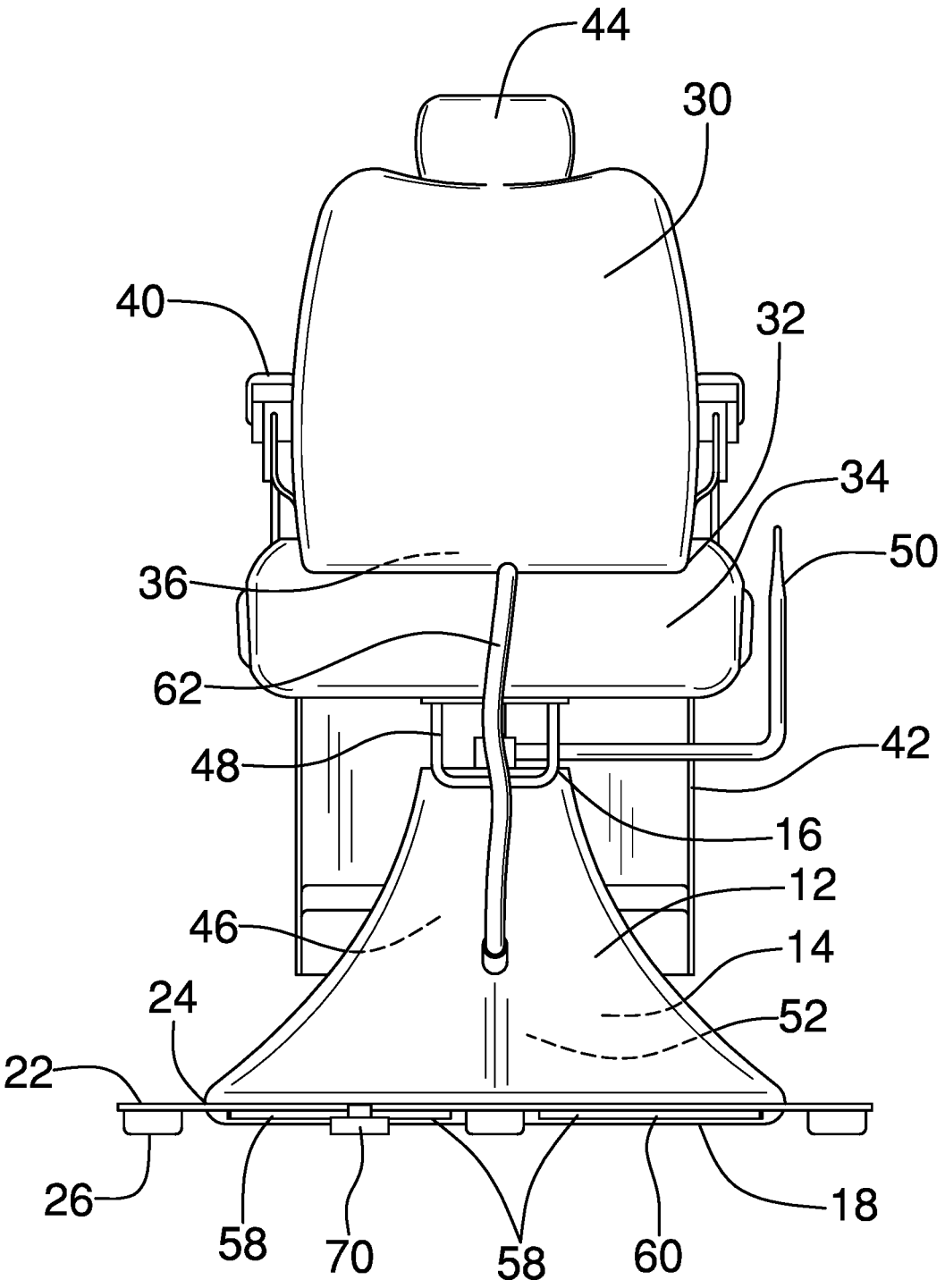
FIG. 2 is a rear view of an embodiment of the disclosure.
Figure 3:
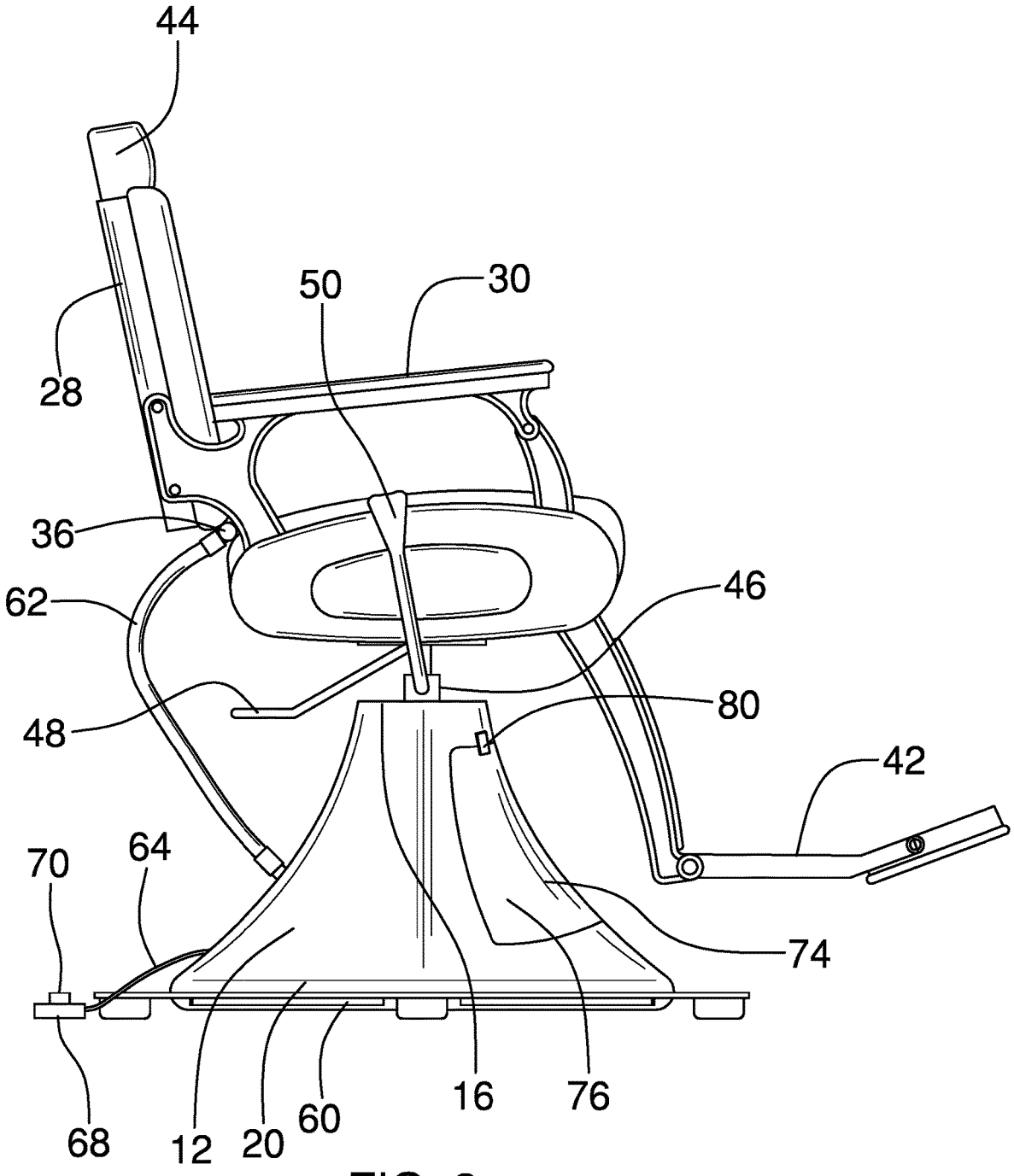
FIG. 3 is a side view of an embodiment of the disclosure.
Figure 4:
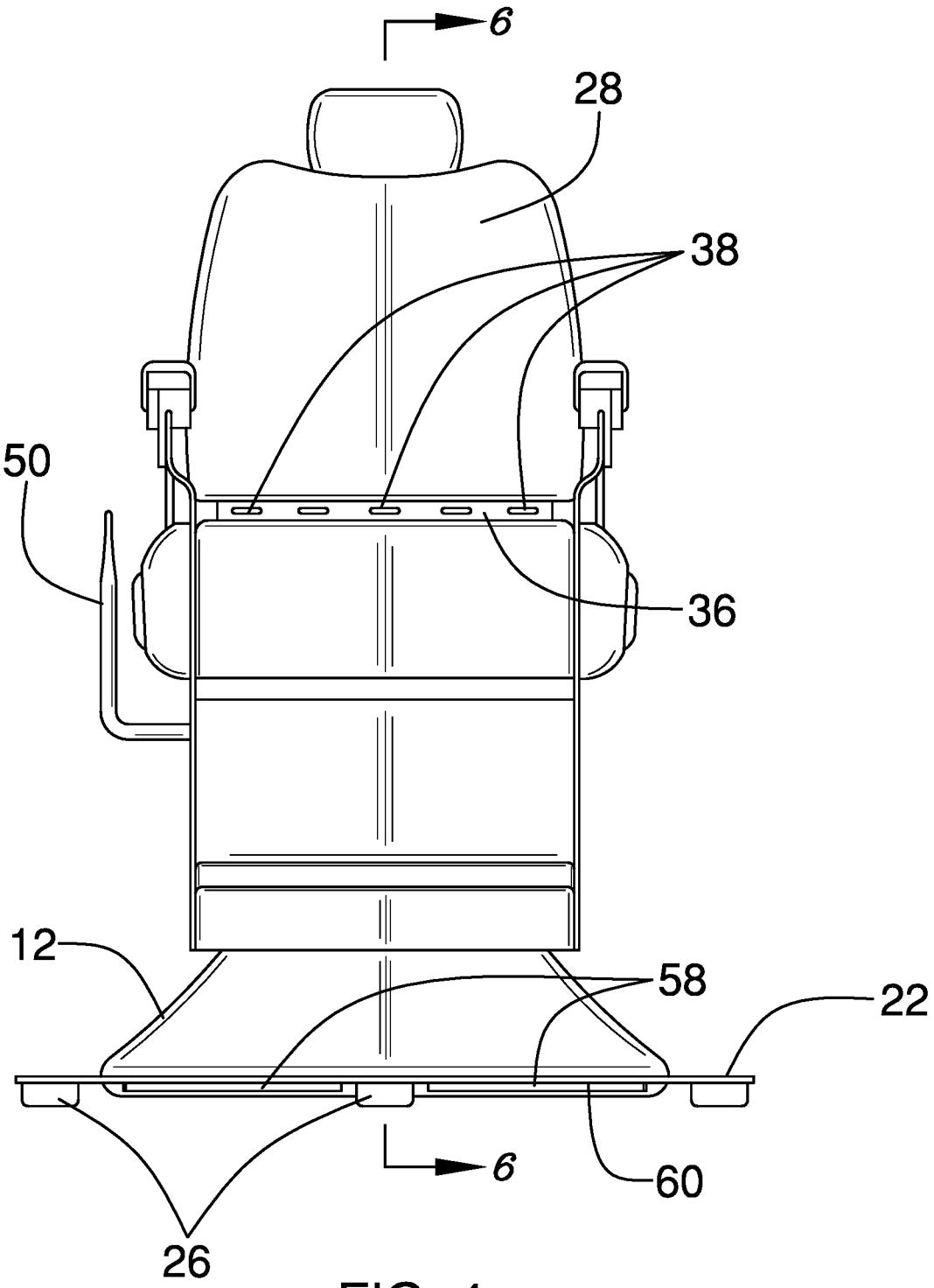
FIG. 4 is a front view of an embodiment of the disclosure.

With reference now to the drawings, and in particular to FIGS. 1 through 7 thereof, a new chair assembly embodying the principles and concepts of an embodiment of the disclosure and generally designated by the reference numeral 10 will be described.

Figure 5:
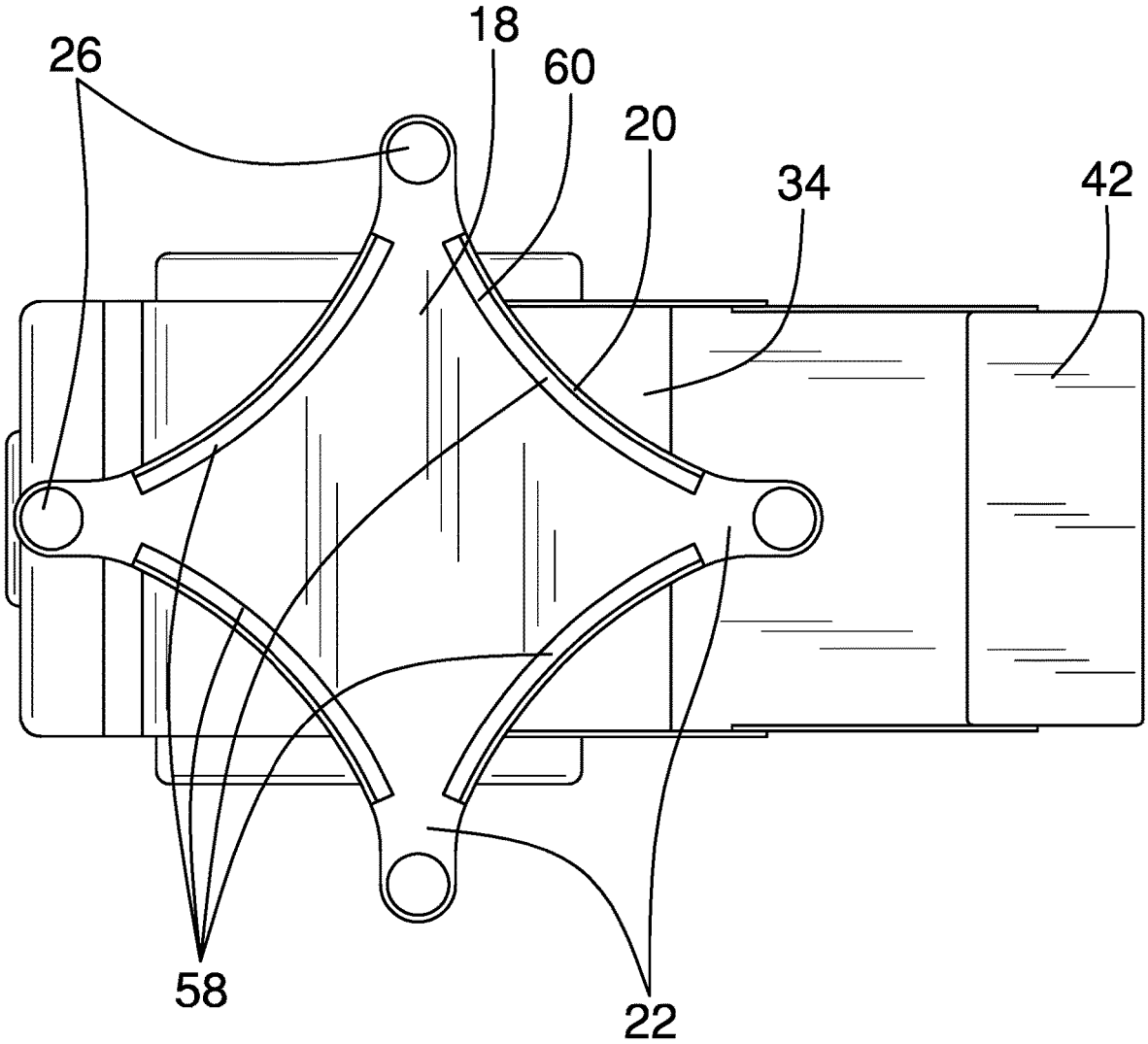
FIG. 5 is a bottom view of an embodiment of the disclosure.
Figure 6:
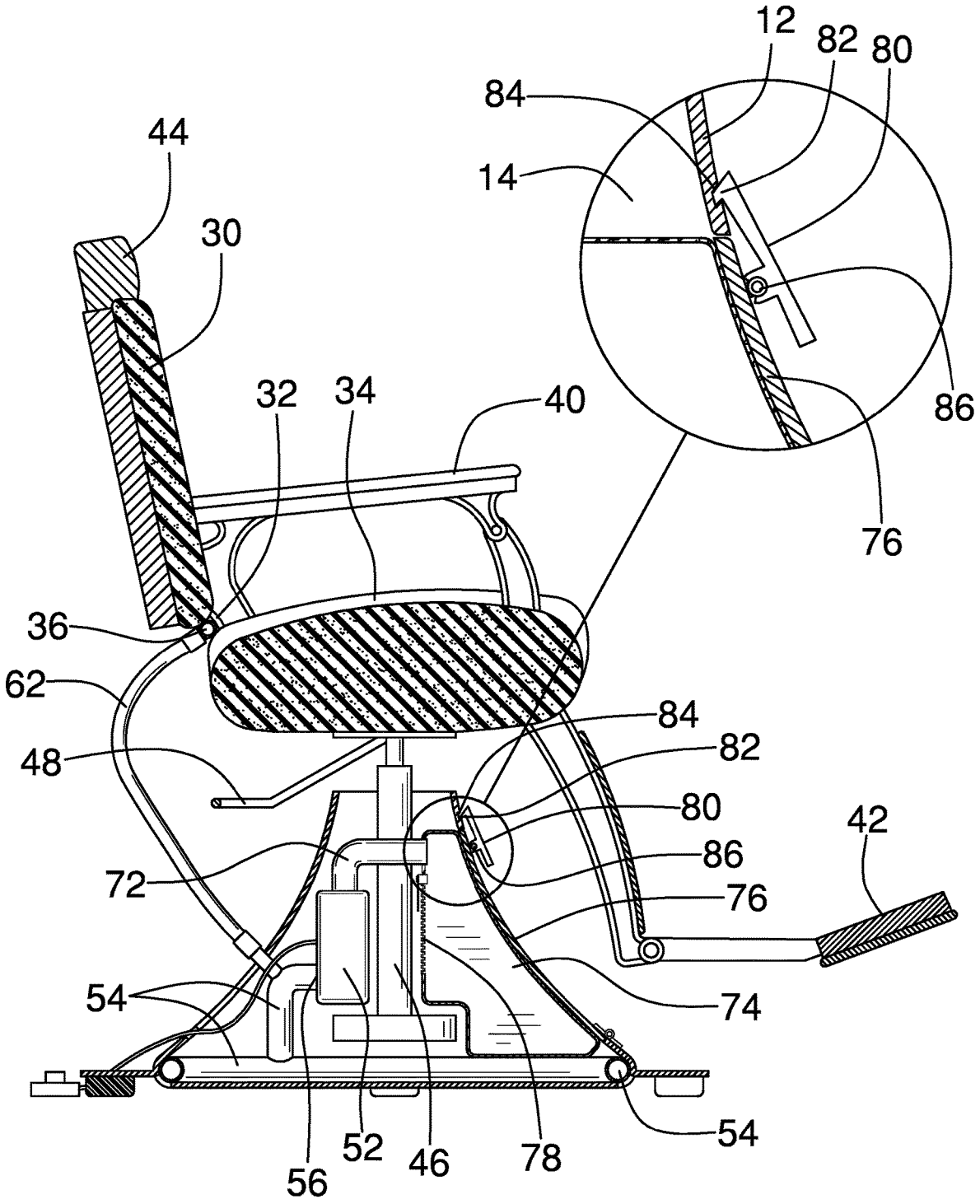
FIG. 6 is a cross-sectional view of an embodiment of the disclosure.

As best illustrated in FIGS. 1 through 7, the self cleaning chair assembly 10 generally comprises a base 12, which defines an interior space 14 and which is configured to be positioned on a substantially horizontal surface. An upper end 16 of the base 12 is circumferentially smaller than a lower end 18 of the base 12 so that the base 12 tapers from the lower end 18 to the upper end 16. The lower end 18 may be substantially rectangularly shaped, as shown in FIG. 5, or alternatively shaped, such as circular, triangular, oval, and the like. Each side 20 of the lower end 18 is concavely arcuate so as to accommodate positioning of feet of a user standing next to the base 12.

Each of a set of extensions 22 is engaged to and extends from a respective corner 24 of the lower end 18 of the base 12. Each of a set of pads 26 is engaged to a respective extension 22 distal from the base 12. The pads 26 are configured to elevate the lower end 18 of the base 12 from the substantially horizontal surface. As will become apparent, the lower end 18 of the base 12 being elevated from the substantially horizontal surface facilitates suctioning of hair from the substantially horizontal surface proximate to the base 12.

A chair 28 is rotatably engaged to the upper end 16 of the base 12. The chair 28 is selectively extensible from the base 12. The chair 28 comprises a backrest 30, which is engaged to and which extends from a rear edge 32 of a seat 34. The seat 34 and the backrest 30 are configured to seat a client and to support a back of the client, respectively. The backrest 30 may be hingedly engaged to the seat 34. A tube 36 is engaged to the chair 28 and extends along the rear edge 32 of the seat 34. A plurality of openings 38 is positioned in the tube 36.

As shown in FIG. 1, the chair 28 also comprises a pair of armrests 40, which are engaged to the seat 34 and which are configured to support arms of the client. A footrest 42 is engaged to the seat 34 distal from the backrest 30 and is configured to support feet of the client. A headrest 44 is engaged to the backrest 30 distal from the seat 34 and is configured to support a head of the client.

A hydraulic cylinder 46 is positioned in the base 12. The hydraulic cylinder 46 is engaged to the seat 34 and is positioned to selectively elevate the chair 28 from the base 12. An actuating arm 48 is operationally engaged to the hydraulic cylinder 46 and is configured to be pumped to selectively elevate the chair 28. A release arm 50 is operationally engaged to the hydraulic cylinder 46. The release arm 50 is positioned to be rotated to depressurize the hydraulic cylinder 46 to lower the chair 28. The present invention also anticipates the hydraulic cylinder 46 being powered by a motor (not shown).

A vacuum module 52 is engaged to the base 12 and is positioned in the interior space 14. An intake pipe 54 is engaged to and extends from an inlet 56 of the vacuum module 52. The intake pipe 54 extends substantially circumferentially around the lower end 18 of the base 12. A plurality of apertures 58 extends through the base 12 and into the intake pipe 54. Each aperture 58 may comprise a slot 60, which extends along a respective side 20 of the lower end 18 of the base 12.

A hose 62 is engaged to and extends between the intake pipe 54 and the tube 36 so that the tube 36 is in fluidic communication with the vacuum module 52. The vacuum module 52 thus is configured to suction in hair, which is trimmed from the client, from the substantially horizontal surface proximate to the base 12 and from the chair 28.

A power cord 64 is operationally engaged to the vacuum module 52 and extends from the base 12. A plug 66 of the power cord 64 is configured for insertion into an outlet to operationally engage the vacuum module 52 to a source of electrical current. A switch 68 is operationally engaged to the power cord 64 and to the vacuum module 52. The switch 68 is configured to be switched to selectively engage the vacuum module 52 to the source of electrical current. The switch 68 may comprise a depressible button 70, which is positioned in the power cord 64, or other switching means, such as, but not limited to, toggles, slides, and the like. The depressible button 70 is configured to be depressed a first time with a foot of the user to engage the vacuum module 52 to the source of electrical current and to be depressed a second time to disengage the vacuum module 52 from the source of electrical current.

An exhaust pipe 72 extends from the vacuum module 52 so that the interior space 14 is in fluidic communication with the vacuum module 52. The interior space 14 is configured to receive the hair. A void 74 is positioned in the base 12 and opens into the interior space 14. The void 74 is configured to allow access to the interior space 14. A panel 76 is hingedly engaged to the base 12 and is selectively engageable to the base 12 to selectively close the void 74. A bag 78 is selectively insertable into the interior space 14 and is configured to sealably engage the exhaust pipe 72. The bag 78 thus is configured to receive the hair.

A latch 80 is hingedly engaged to the panel 76 so that a tab 82 of the latch 80 is positioned to selective insert into a notch 84 in the base 12 to fixedly engage the panel 76 to the base 12. A spring 86 is engaged to the latch 80 and the panel 76 so that the latch 80 is biased to a configuration wherein the tab 82 is positioned in the notch 84.

Figure 7:
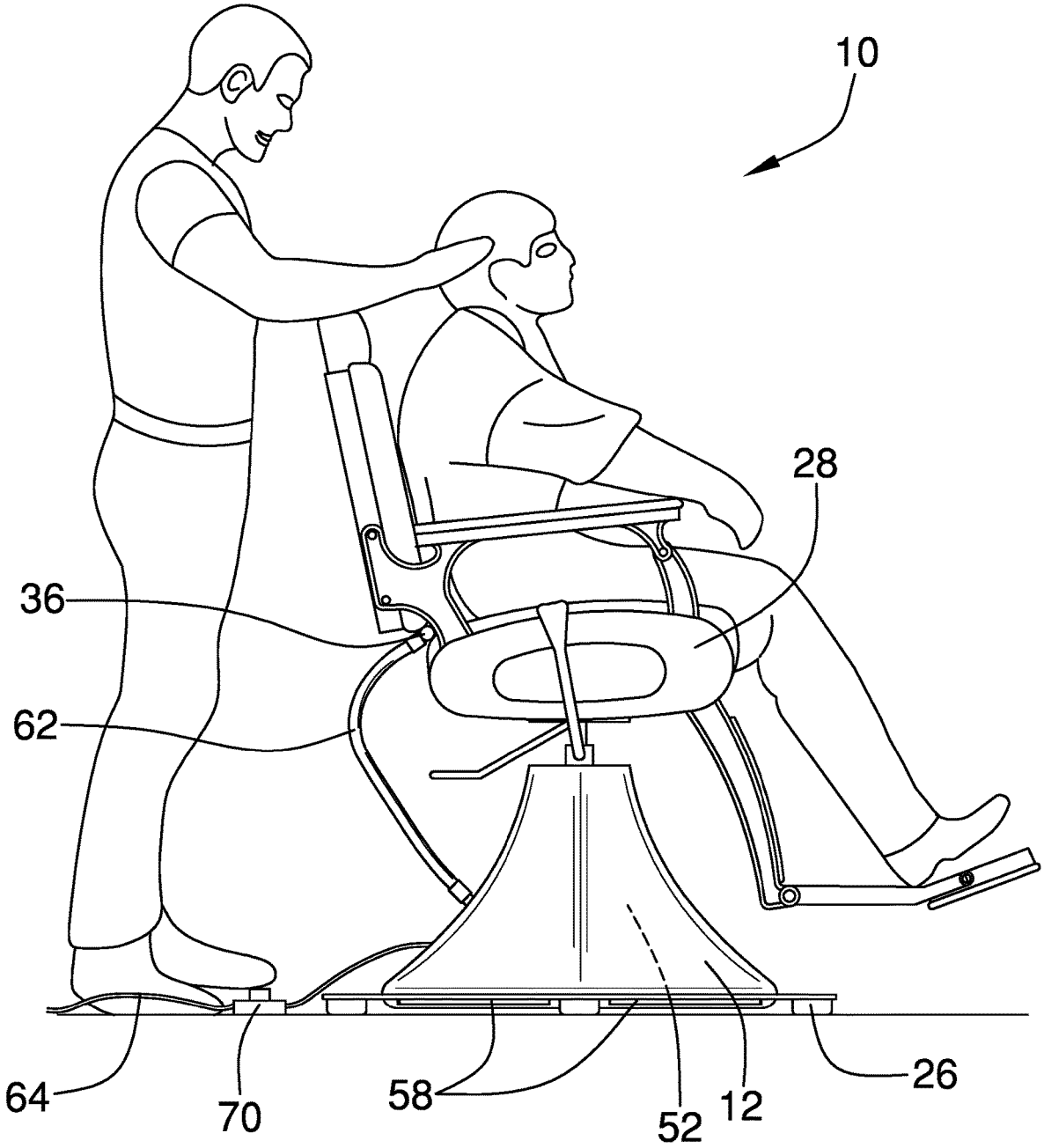
FIG. 7 is an in-use view of an embodiment of the disclosure.

In use, the self cleaning chair assembly 10 is utilized to seat a client for hair trimming, cutting, or the like, as may be performed by a barber or hair stylist, as shown in FIG. 7. As the hair is cut, the user can actuate the vacuum module 52 by stepping on the depressible button 70. The vacuum module 52 suctions in hair from a surface proximate to the base 12, through the apertures 58, and from the chair 28, through the openings 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A self cleaning chair assembly comprising:

a base configured for positioning on a substantially horizontal surface, the base defining an interior space;

a chair rotatably engaged to an upper end of the base, the chair being selectively extensible from the base, the chair comprising:

a seat configured for seating a client, and a backrest engaged to and extending from a rear edge of the seat, wherein the backrest is configured for supporting a back of the client;

a vacuum module engaged to the base and positioned in the interior space;

an intake pipe engaged to and extending from an inlet of the vacuum module, the intake pipe extending substantially circumferentially around a lower end of the base;

a plurality of apertures extending through the base into the intake pipe;

a tube engaged to the chair and extending along the rear edge of the seat;

a plurality of openings positioned in the tube; and a hose engaged to and extending between the intake pipe and the tube, such that the tube is in fluidic communication with the vacuum module, wherein the vacuum module is configured for suctioning in hair trimmed from the client from the substantially horizontal surface proximate to the base and from the chair.

2. The self cleaning chair assembly of claim 1, wherein the upper end of the base is circumferentially smaller than the lower end of the base, such that the base tapers from the lower end to the upper end.

3. The self cleaning chair assembly of claim 1, wherein: the lower end is substantially rectangularly shaped; and each side of the lower end is concavely arcuate.

4. The self cleaning chair assembly of claim 3, further including:

a set of extensions, each extension being engaged to and extending from a respective corner of the lower end of the base; and a set of pads, each pad being engaged to a respective extension distal from the base, wherein the pads are configured for elevating the lower end of the base from the substantially horizontal surface.

5. The self cleaning chair assembly of claim 1, further including the chair comprising:

a pair of armrests engaged to the seat, wherein the armrests are configured for supporting arms of the client;

a footrest engaged to the seat distal from the backrest, wherein the footrest is configured for supporting feet of the client; and a headrest engaged to the backrest distal from the seat, wherein the headrest is configured for supporting a head of the client.

6. The self cleaning chair assembly of claim 1, further including:

a hydraulic cylinder positioned in the base, the hydraulic cylinder being engaged to the seat, such that the hydraulic cylinder is positioned for selectively elevating the chair from the base;

an actuating arm operationally engaged to the hydraulic cylinder, wherein the actuating arm is configured for pumping for selectively elevating the chair; and a release arm operationally engaged to the hydraulic cylinder, wherein the release arm is positioned for rotating for depressurizing the hydraulic cylinder for lowering the chair.

7. The self cleaning chair assembly of claim 3, further including each aperture comprising a slot extending along a respective side of the lower end of the base.

8. The self cleaning chair assembly of claim 1, further including:

a power cord operationally engaged to the vacuum module and extending from the base, wherein a plug of the power cord is configured for insertion into an outlet for operationally engaging the vacuum module to a source of electrical current; and a switch operationally engaged to the power cord and the vacuum module, wherein the switch is configured for switching for selectively engaging the vacuum module to the source of electrical current.

9. The self cleaning chair assembly of claim 8, wherein the switch comprises a depressible button positioned in the power cord, wherein the depressible button is configured for depressing a first time with a foot of a user for engaging the vacuum module to the source of electrical current and for depressing a second time for disengaging the vacuum module from the source of electrical current.

10. The self cleaning chair assembly of claim 1, further including an exhaust pipe extending from the vacuum module, such that the interior space is in fluidic communication with the vacuum module, wherein the interior space is configured for receiving the hair.

11. The self cleaning chair assembly of claim 10, further including:

a void positioned in the base and opening into the interior space, wherein the void is configured for accessing the interior space; and a panel hingedly engaged to the base, the panel being selectively engageable to the base, such that the panel is positioned for selectively closing the void.

12. The self cleaning chair assembly of claim 11, further including a bag selectively insertable into the interior space, the bag being configured for sealably engaging the exhaust pipe, wherein the bag is configured for receiving the hair.

13. The self cleaning chair assembly of claim 11, further including:

a latch hingedly engaged to the panel, such that a tab of the latch is positioned for selective insertion into a notch in the base for fixedly engaging the panel to the base; and a spring engaged to the latch and the panel, such that the latch is biased to a configuration wherein the tab is positioned in the notch.

14. A self cleaning chair assembly comprising:

a base configured for positioning on a substantially horizontal surface, the base defining an interior space, an upper end of the base being circumferentially smaller than a lower end of the base, such that the base tapers from the lower end to the upper end, the lower end being substantially rectangularly shaped, each side of the lower end being concavely arcuate;

a set of extensions, each extension being engaged to and extending from a respective corner of the lower end of the base;

a set of pads, each pad being engaged to a respective extension distal from the base, wherein the pads are configured for elevating the lower end of the base from the substantially horizontal surface;

a chair rotatably engaged to the upper end of the base, the chair being selectively extensible from the base, the chair comprising:

a seat configured for seating a client, a backrest engaged to and extending from a rear edge of the seat, wherein the backrest is configured for supporting a back of the client, a pair of armrests engaged to the seat, wherein the armrests are configured for supporting arms of the client, a footrest engaged to the seat distal from the backrest, wherein the footrest is configured for supporting feet of the client, and a headrest engaged to the backrest distal from the seat, wherein the headrest is configured for supporting a head of the client;

a hydraulic cylinder positioned in the base, the hydraulic cylinder being engaged to the seat, such that the hydraulic cylinder is positioned for selectively elevating the chair from the base;

an actuating arm operationally engaged to the hydraulic cylinder, wherein the actuating arm is configured for pumping for selectively elevating the chair;

a release arm operationally engaged to the hydraulic cylinder, wherein the release arm is positioned for rotating for depressurizing the hydraulic cylinder for lowering the chair;

a vacuum module engaged to the base and positioned in the interior space;

an intake pipe engaged to and extending from an inlet of the vacuum module, the intake pipe extending substantially circumferentially around the lower end of the base;

a plurality of apertures extending through the base into the intake pipe, each aperture comprising a slot extending along a respective side of the lower end of the base;

a tube engaged to the chair and extending along the rear edge of the seat;

a plurality of openings positioned in the tube;

a hose engaged to and extending between the intake pipe and the tube, such that the tube is in fluidic communication with the vacuum module, wherein the vacuum module is configured for suctioning in hair trimmed from the client from the substantially horizontal surface proximate to the base and from the chair;

a power cord operationally engaged to the vacuum module and extending from the base, wherein a plug of the power cord is configured for insertion into an outlet for operationally engaging the vacuum module to a source of electrical current;

a switch operationally engaged to the power cord and the vacuum module, wherein the switch is configured for switching for selectively engaging the vacuum module to the source of electrical current, the switch comprising a depressible button positioned in the power cord, wherein the depressible button is configured for depressing a first time with a foot of a user for engaging the vacuum module to the source of electrical current and for depressing a second time for disengaging the vacuum module from the source of electrical current;

an exhaust pipe extending from the vacuum module, such that the interior space is in fluidic communication with the vacuum module, wherein the interior space is configured for receiving the hair;

a void positioned in the base and opening into the interior space, wherein the void is configured for accessing the interior space;

a panel hingedly engaged to the base, the panel being selectively engageable to the base, such that the panel is positioned for selectively closing the void;

a bag selectively insertable into the interior space, the bag being configured for sealably engaging the exhaust pipe, wherein the bag is configured for receiving the hair;

a panel hingedly engaged to the base, the panel being selectively engageable to the base, such that the panel is positioned for selectively closing the void;

a latch hingedly engaged to the panel, such that a tab of the latch is positioned for selective insertion into a notch in the base for fixedly engaging the panel to the base; and a spring engaged to the latch and the panel, such that the latch is biased to a configuration wherein the tab is positioned in the notch.

* * * * *